US008215315B2

(12) United States Patent
Atwell et al.

(10) Patent No.: US 8,215,315 B2
(45) Date of Patent: Jul. 10, 2012

(54) CONCENTRIC CORE TOBACCO ROD MAKER WITH AIR TRANSPORTER

(75) Inventors: Charles G. Atwell, Mechanicsville, VA (US); Robert C. Lanier, Jr., Moseley, VA (US); Martin T. Garthaffner, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 744 days.

(21) Appl. No.: 12/343,704

(22) Filed: Dec. 24, 2008

(65) Prior Publication Data

US 2009/0272389 A1 Nov. 5, 2009

Related U.S. Application Data

(60) Provisional application No. 61/017,274, filed on Dec. 28, 2007.

(51) Int. Cl.
*A24C 5/18* (2006.01)

(52) U.S. Cl. ..... 131/84.3; 131/84.1; 131/84.4; 131/84.2

(58) Field of Classification Search ..... 131/84.1, 131/84.2, 84.3, 84.4
See application file for complete search history.

(56) References Cited

U.S. PATENT DOCUMENTS

| | | | | |
|---|---|---|---|---|
| 6,390,100 | B1 | 5/2002 | Schumacher et al. | |
| 2005/0155614 | A1 * | 7/2005 | Draghetti et al. | 131/84.4 |

FOREIGN PATENT DOCUMENTS

| | | |
|---|---|---|
| EP | 1004248 | 5/2000 |
| FR | 1479303 | 5/1967 |
| GB | 2133966 | 8/1984 |
| GB | 2260887 | 5/1993 |
| GB | 2289836 | 12/1995 |
| WO | WO-2008081345 | 7/2008 |

* cited by examiner

*Primary Examiner* — Richard Crispino
*Assistant Examiner* — Dionne Walls Mayes
(74) *Attorney, Agent, or Firm* — Connolly Bove Lodge & Hutz LLP

(57) ABSTRACT

The present invention is directed at various apparatus, systems and methods for forming a sealed concentric or sealed concentric hollow core tobacco rod. The methods of the invention at least comprise passing a trimmed column of metered tobacco and paper between a tongue and garniture to form a concentric shaped tobacco rod or tobacco rod with an inner hollow core; maintaining the concentric shape; and outputting a sealed concentric tobacco rod or a concentric hollow tobacco rod.

7 Claims, 6 Drawing Sheets

CONCENTRIC CORE TOBACCO ROD MAKER WITH AIR TRANSPORTER

CROSS REFERENCE TO RELATED APPLICATION

The present application claims the benefits of provisional application Ser. No. 61/017,274, filed Dec. 28, 2007.

FIELD OF INVENTION

The field of the invention relates to apparatus and methods for making cigarettes, and more particularly to making cigarettes with a concentric core tobacco rod and filter structure with an air transporter.

WORKING ENVIRONMENT

Methods and apparatus for cigarette manufacturing machines are configured with a separate tobacco rod-making/filter-forming section joined in line with a tobacco-processing hopper with stem extraction and weight control section that prepares the tobacco stream for the rod making/filter forming section. In particular, manufacturing cigarettes consist of a tobacco-processing hopper section that feeds the tobacco to a rod forming section that wraps the tobacco with paper. The tobacco-processing hoppers receive the tobacco automatically from a bulk or mass tobacco processing facility. The hoppers then perform stem extraction and weight control trimming of the tobacco filler.

FIG. 1 shows a side view of a cigarette manufacturing apparatus. In particular, a tobacco feed 1 is provided to a tobacco hopper 12 that is connected to a tobacco metering device 11. The tobacco metering device 11 is driven by a motor 13 that provides metered tobacco 15 to a tobacco feeding plenum 14. The metered tobacco 15 is fed to a tobacco wheel 10 that is turned by a tobacco wheel shaft 22.

As shown in an exemplary front view of the cigarette making apparatus given in FIG. 2, the tobacco wheel 10 further comprises a vacuum chamber 17 that provides a suction force to pull the metered tobacco 15 into tobacco fill grooves 19 on the tobacco wheel 10. Further, FIG. 2 shows the tobacco fill grooves 19 further comprise tobacco rod end pockets 20. These tobacco rod end pockets 20 ensure a degree of firmness at the ends of the tobacco rods that are provided to the apparatus from the fill grooves 19.

Returning to FIG. 1, tobacco trimmers 3 remove excess metered tobacco 15 from the tobacco filled grooves 19 of tobacco wheel 10. The trimmed tobacco 2A is returned to the cigarette manufacturing apparatus for reuse via the excess tobacco return shaft 21B. In addition, as shown in FIG. 1, the cigarette manufacturing apparatus further comprises a tube belt 4 that carries the tobacco rod center core 17 that comes off of the tobacco wheel 10 into the tobacco rod maker section of the apparatus. Along the tube belt 4 is a guide 5 for performing paper 6 around the tobacco rod center core 17 as the tobacco rod comes of the tobacco wheel 10. The tobacco rod center core 17 is moved onto the paper 6 that is moving along the tube belt by positive air pressure 17 in the tobacco wheel 10 at the point where the tube belt 4 and the paper 6 meet the tobacco wheel 10.

Excess tobacco from the tobacco rod center core 17 is removed as the paper 6 and tobacco rod center core 17 pass between a tongue 9 and a garniture 7 of the apparatus. FIG. 3 shows the tobacco rod center 17 resting on the paper 6 with an open top and a rounded bottom formed by the garniture 7 after the tongue 9 has removed excess tobacco. Further, FIG. 4 shows the tobacco rod center core 17 after a folder 8A has closed the open top of the tobacco rod center core 17 to form a final tobacco rod center core 17' that is output from the cigarette making apparatus.

The embodiments herein provide a more efficient way to manufacture a concentric core and filter in a tobacco rod and a method for producing such a tobacco rod.

SUMMARY OF THE INVENTION

Embodiments of the invention provide a simple mechanism by which many variations of concentric core and hollow core concentric tobacco rods can be manufactured for cigarette production. Embodiments may be used in a lab type environment for making machine made samples in small batch quantities for product development and testing and expanded into a manufacturing process for high speed concentric or hollow core concentric cigarette manufacturing.

Embodiment of the invention provide for the separation of the rod forming section and the tobacco-processing hopper with the resulting machine having the tobacco hopper being offset from the rod forming section. The position of the tobacco hopper in embodiments of the invention is flexible but should allow for introduction of another material flow nearly in-line with the downstream rod forming section. In a preferred embodiment, for example, the tobacco-processing hopper could be offset to a position further behind and above. In addition, embodiments provide a much simpler tobacco preparation device that extracts stem and meters the flow.

Embodiments of the invention allow for small quantity production of many variations for product development while at the same time lending itself to be scaled up to a high speed-making machine. Embodiments make it possible to introduce a wide variety of rods and tubes into the center of a tobacco rod including but not limited to: (1) another tobacco or other preformed rod; and (2) continuous tube made up of paper or MAT (tobacco paper made from pulp fiber and finely ground tobacco), (see U.S. Pat. No. 5,875,824 incorporated herein by reference) or extruded materials, said tubes that have been crimped in strategically placed spaces. Another potential benefit of this invention will be derived from a change in tobacco strand orientation within the cigarette rod. Rod-making/filter-forming apparatus orient strands axially while embodiments of the invention will orient tobacco strand more transversely. That is, embodiments allow for firmer cigarettes with less tobacco and will result in significant tobacco yield and weight savings.

In addition, embodiments of the invention reconfigure the tow processing/filter making process into a more compact arrangement without losing filter making capability (i.e. speed, quality, tow yield, waste, etc.). Embodiments repackage tow processing so that the rod forming section is lower to the ground.

Further, embodiments remount the tow blooming/PZ (plasticizer) application on a new back plate over top of the rod forming section. This configuration has never been possible without significant negative impact on product quality/tow yield capability because of the loss of tow bloom and PZ contamination while changing direction. However, the air transport system allows the bending of the tow without hard roller or guide contact. This capability allows for the directional change without loss of bloom or PZ contamination. Moreover, an alternative to the air transport system may be a second set of blooming rollers vertically stacked.

One embodiment of the invention is an apparatus for concentric rod-making/filter-forming, comprising: a hopper configured to receive a tobacco feed; a metering device connected to the hopper, wherein the metering device is configured to meter the tobacco feed received from the hopper; a tobacco feeding plenum connected to the metering device, wherein the tobacco feeding plenum is configured to distribute the metered tobacco at an output of the tobacco feeding plenum; a rotating vacuum wheel located proximate to the output of the tobacco feeding plenum, wherein the rotating vacuum wheel is configured to receive the metered tobacco; an excess tobacco return chamber connected to a distal portion of the tobacco feeding plenum and proximate to the rotating vacuum wheel, wherein the excess tobacco return chamber is configured to receive tobacco feed outside of grooves of the rotating vacuum wheel; an input feeding chamber connected proximate to a release point of the rotating vacuum wheel and configured to receive columns of metered tobacco strands released from the rotating vacuum wheel; an air transport device connected to an output of the input feeding chamber, wherein the air transport device is configured to transport the columns of metered tobacco strands to a rod-making/filter forming section; and a rod-making/filter forming section connected to the air transport device, wherein the rod-making/filter forming section is configured to combine at least one of the columns of metered tobacco strands and inserted material with preformed paper forming at least one of a concentric tobacco rod and a hollow concentric tobacco rod.

In addition, the rod-making/filter forming section of this embodiment further comprises a dual-section end chamber located proximate to an output of the air transport device, wherein the dual-section reducer is configured to provide compressed air for transport of the columns of metered tobacco strands, adjust the compressed air balance in accordance with a venturi effect due to adjusting the position of the air transport chamber; and provide relief for the compressed air through a perforated air relief sleeve.

Further, the rod-making/filter forming section of this embodiment further comprises: a tube-belt, wherein the tube-belt is configured to move preformed paper to an output of dual-section reducer; a garniture connected to the lower portion of the perforated relief sleeve at the output of the dual-section end chamber, wherein the garniture is configured to shape and support the preformed paper provided by the tube-belt and the columns of metered tobacco strands formed into a rod within the preformed paper; and a tongue connected to the upper portion of the perforated relief sleeve at the output of the dual-section end chamber, wherein the tongue is configured to shape columns of metered tobacco strands output from the dual-section end chamber; a dust collection device connected to the dual-section end chamber and enclosing the perforated relief sleeve, the tongue and a portion of the garniture, wherein the dust collection device is configured to remove dust and air from the rod-making/filter-forming section; and a folder connected to the tongue, wherein the folder is configured to seal a top seam of the paper forming the output of at least one of a concentric tobacco rod and a hollow concentric tobacco rod.

Another embodiment of the invention is a system for cigarette manufacturing, comprising: a tow bale of tobacco product; a shaft connected to the tow bale, wherein the shaft is configured to advance the tobacco product to an output of the shaft; a plurality of blooming rollers, wherein the blooming rollers are configured to receive and provide an output of tobacco feed; a hopper configured to receive the tobacco feed; a metering device connected to the hopper, wherein the metering device is configured to meter the tobacco feed received from the hopper; a tobacco feeding plenum connected to the metering device, wherein the tobacco feeding plenum is configured to distribute the metered tobacco at an output of the tobacco feeding plenum; a rotating vacuum wheel located proximate to the output of the tobacco feeding plenum, wherein the rotating vacuum wheel is configured to receive the metered tobacco; an excess tobacco return chamber connected to a distal portion of the tobacco feeding plenum and proximate to the rotating vacuum wheel, wherein the excess tobacco return chamber is configured to receive tobacco feed outside of grooves of the rotating vacuum wheel; an input feeding chamber connected proximate to a release point of the rotating vacuum wheel and configured to receive columns of metered tobacco strands released from the rotating vacuum wheel; an air transport device connected to an output of the input feeding chamber, wherein the air transport device is configured to transport the columns of metered tobacco strands to a rod-making/filter forming section; and a rod-making/filter forming section connected to the air transport device, wherein the rod-making/filter forming section is configured to combine at least one of the columns of metered tobacco strands and inserted material with preformed paper forming at least one of a concentric tobacco rod and a hollow concentric tobacco rod.

In addition, in the system of this embodiment the rod-making/filter forming section further comprises a dual-section end chamber located proximate to an output of the air transport device, wherein the dual-section reducer is configured to provide compressed air for transport of the columns of metered tobacco strands, adjust the compressed air balance in accordance with a venturi effect due to adjusting the position of the air transport chamber; and provide relief for the compressed air through a perforated air relief sleeve.

Further, in the system of this embodiment the rod-making/filter forming section further comprises: a tube-belt, wherein the tube-belt is configured to move preformed paper to an output of dual-section reducer; a garniture connected to the lower portion of the perforated relief sleeve at the output of the dual-section end chamber, wherein the garniture is configured to shape and support the preformed paper provided by the tube-belt and the columns of metered tobacco strands formed into a rod within the preformed paper; and a tongue connected to the upper portion of the perforated relief sleeve at the output of the dual-section end chamber, wherein the tongue is configured to shape columns of metered tobacco strands output from the dual-section end chamber; a dust collection device connected to the dual-section end chamber and enclosing the perforated relief sleeve, the tongue and a portion of the garniture, wherein the dust collection device is configured to remove dust and air from the rod-making/filter-forming section; and a folder connected to the tongue, wherein the folder is configured to seal a top seam of the paper forming the output of at least one of a concentric tobacco rod and a hollow concentric tobacco rod.

Yet another embodiment of the invention is a method for making at least one of concentric and concentric hollow tobacco rods, comprising: receiving a tobacco feed in a hopper; metering the tobacco feed received from the hopper; distributing the metered tobacco feed at an output of a tobacco feeding plenum; rotating a vacuum wheel at the output of the tobacco feeding plenum receiving the metered tobacco in grooves and endpoints of the rotating vacuum wheel; returning excess tobacco for later processing through a return chamber; releasing columns of metered tobacco strands from a release point of the rotating vacuum wheel; transporting the columns of metered tobacco strands on air to a rod-making/filter forming section; combining at least one of the columns of metered tobacco strands and inserted material with preformed paper; and forming at least one of a concentric tobacco rod and a hollow concentric tobacco rod.

In addition, in this embodiment the method of transporting the columns of metered tobacco strands further comprises: providing compressed air for transporting the columns of metered tobacco strands; adjusting the compressed air balance to produce a venturi effect due to adjustments in a position of an air transport chamber; and providing a relief passage for the compressed air through a perforated air relief sleeve.

Further, in this embodiment, the method of forming at least one of a concentric tobacco rod and a hollow concentric tobacco rod further comprises: moving preformed paper to a position under a plurality of columns of metered tobacco strands an output of dual-section reducer; shaping and supporting the preformed paper provided by the tube-belt and the columns of metered tobacco strands within the preformed paper with a garniture from below the paper; shaping the columns of metered tobacco strands output from the dual-section end chamber with a tongue connected to the upper portion of a perforated air relief sleeve at the output of the dual-section reducer; removing dust from an area enclosing the perforated air relief sleeve, the tongue and a portion of the garniture; and sealing a top seam of the paper to form an output of at least one of a concentric tobacco rod and a hollow concentric tobacco rod.

DETAILED DESCRIPTION OF THE PREFERRED EMBODIMENT

Embodiments of the invention introduce a pneumatic (i.e. operated by compressed air) tobacco air transfer device to convey columns of metered tobacco and pneumatically forms the columns of metered tobacco around a material (e.g., a rod or tube) that is inserted in-line at an opening of the air transport device into a concentric tobacco rod with a garniture, tongue and folder of a rod making/filter forming sections. The material to be inserted into the center of the concentric tobacco rod is for example, but not limited to: another small diameter tobacco rod that is formed in the traditional way but may or may not be cut so that a continuous rod or tube may be fed into the center of the larger tobacco rod being formed. The rod or tube is not limited to other rods or tubes introduced in a similar manner. The concentric or hollow concentric tobacco rods that result will be output from the cigarette maker and may then be fed to another system.

Figure 2:
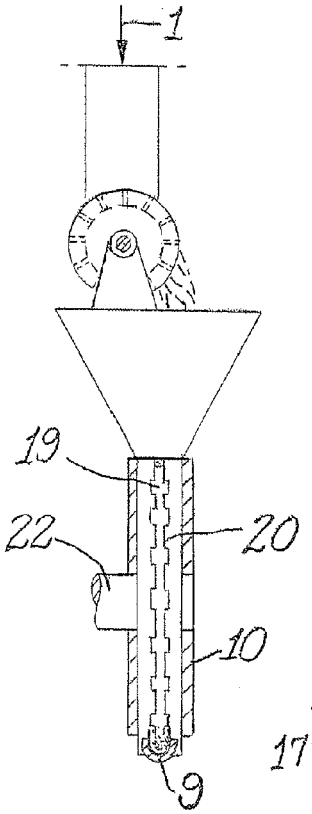
Fig. 2. Background Art
FIG. 2 shows a front view of the cigarette manufacturing apparatus of FIG. 1.
Figure 1:
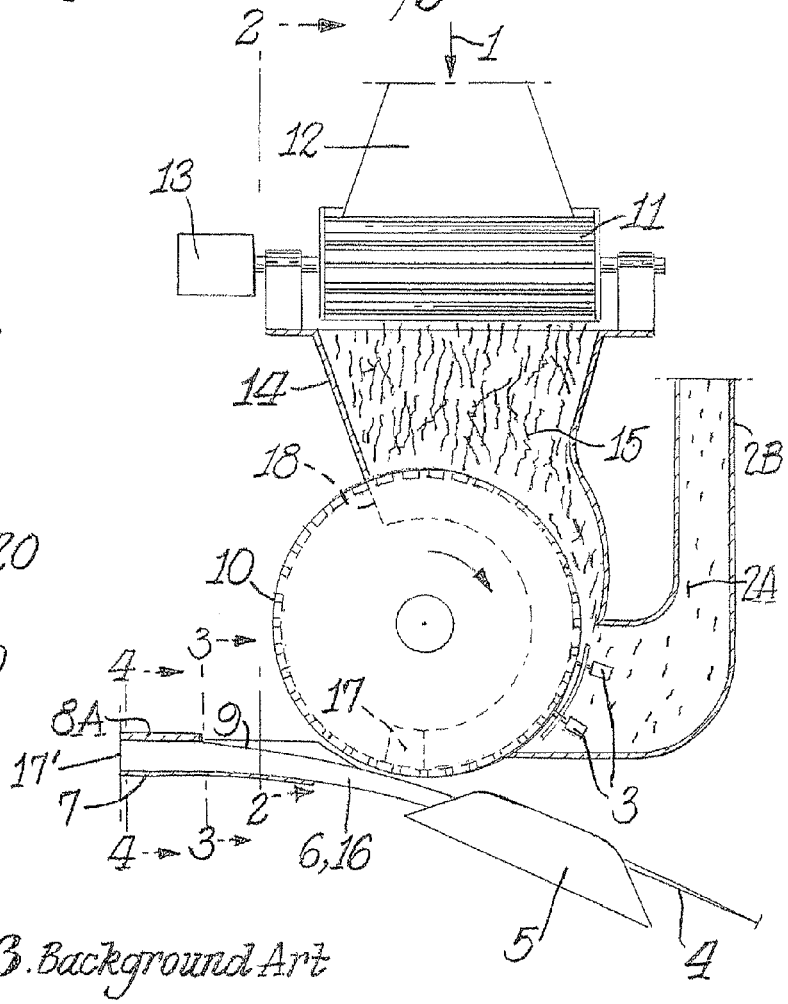
Fig. 1. Background Art
FIG. 1 shows a side view of a cigarette manufacturing apparatus.
Figure 3:
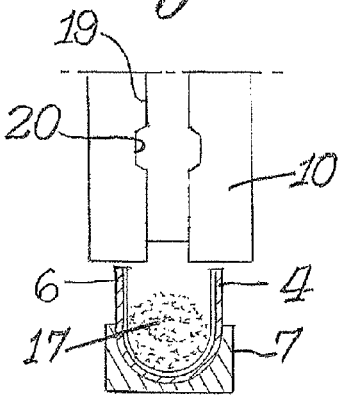
Fig. 3. Background Art
FIG. 3 shows a sectioned view of the output of the apparatus after the tongue and preformed paper is applied to columns of metered tobacco strands.
Figure 4:
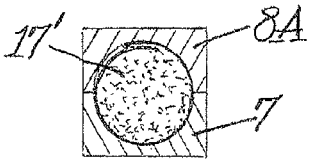
Fig. 4. Background Art
FIG. 4 shows a sectioned view of the output of the apparatus after the folder and garniture is applied to columns of metered tobacco strands.

In embodiments of the invention, instead of being deposited directly onto a paper—tube belt arrangement as discussed and shown in FIG. 1 and FIG. 2, the columns of metered tobacco will be fed into an air transport device with directional air flow toward the output of the cigarette maker. The air transport device (e.g., a pipe or duct) will allow passage of the columns of metered tobacco to form a concentric tobacco rod or flow around an incoming, smaller diameter rod or tube inserted in the center of the air transport device to form a hollow concentric tobacco rod. The inserted in-line rod or tube and columns of metered tobacco strands then enter a tapered venturi that will randomly place or pack the loose columns of metered tobacco strands alone or the columns of metered tobacco strands around the rod or tube that was introduced into the center of the air transport device.

As the newly formed tobacco rod exits the tapered venturi, air is released to atmosphere via a porous or perforated air relief sleeve as the columns of metered tobacco strands are introduced to the paper—tube belt arrangement of the cigarette maker. The paper, tongue and garniture combine to form an open-topped tobacco rod whose seam is then sealed with a folder. The output of the cigarette making apparatus is a closed concentric or hollow closed concentric tobacco rod. Embodiments of the invention are further explained in paragraphs and illustrated in the figures to follow.

Figure 5:
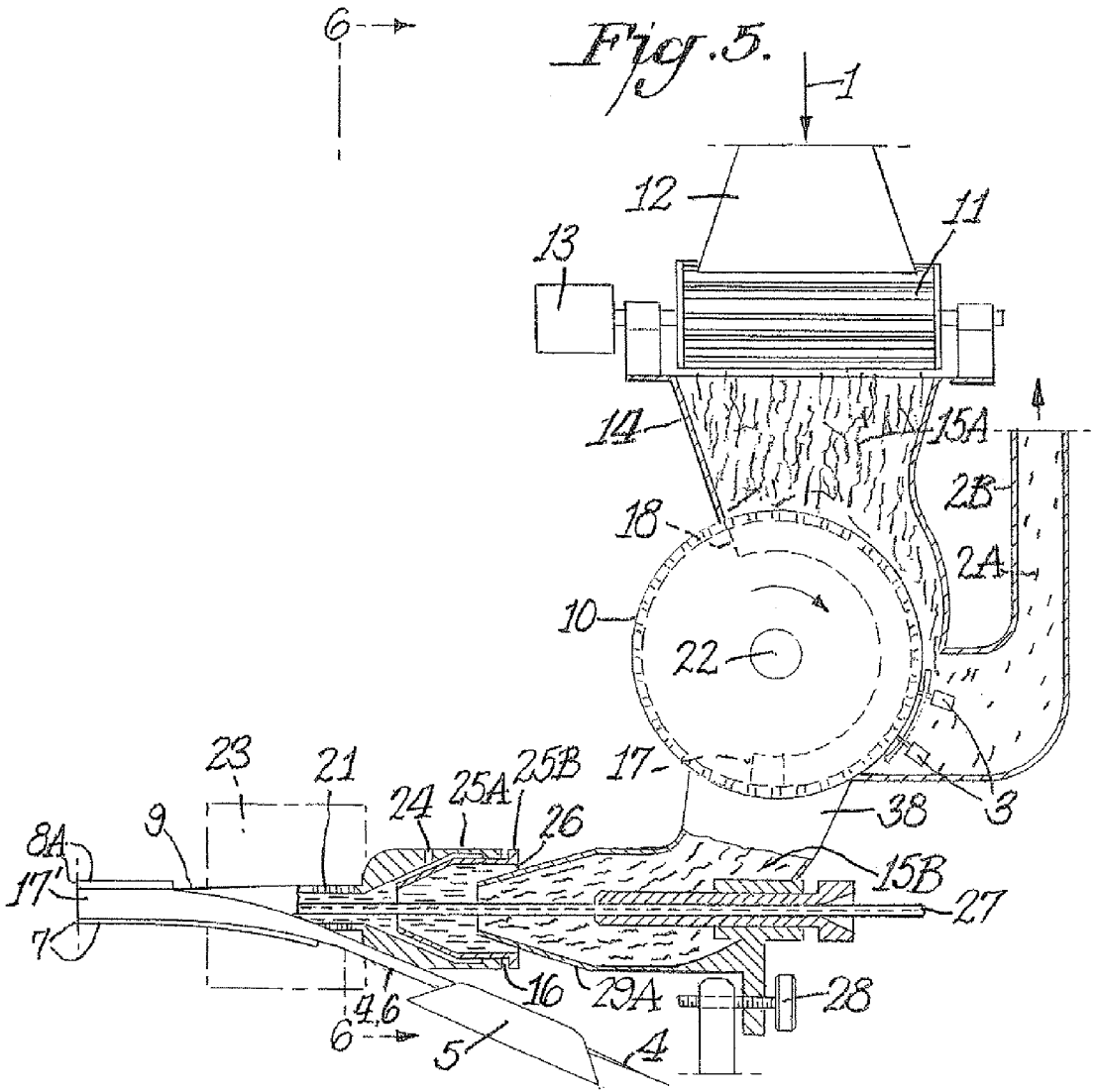
FIG. 5 shows a side view of an exemplary embodiment of the invention.
Figure 6:
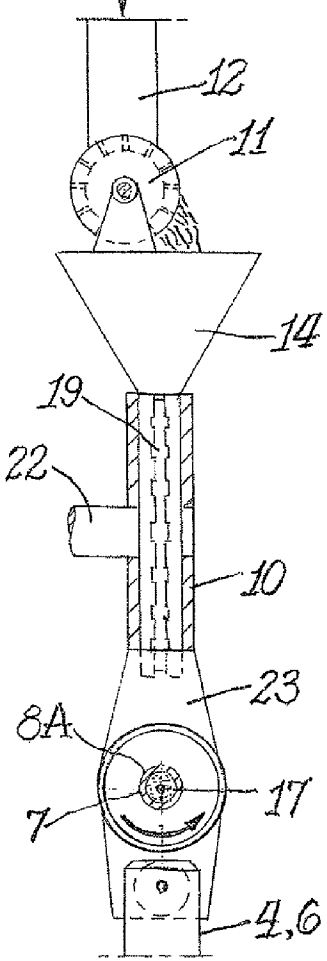
FIG. 6 shows a front view of the exemplary embodiment of the invention shown in FIG. 5.

One exemplary embodiment of the invention is shown in a side and front views in FIG. 5 and FIG. 6, respectively. Some arrangements use air flow and/or flow station chambers to separate the heavy more dense pieces of tobacco from the lighter tobacco strands in individual sections of cigarette making equipment. In contrast, as shown in FIG. 5, embodiments of the invention take the stem extraction process out of individual sections of the cigarette making equipment and create a larger mass stem extraction process either as part of each feeding tobacco 1 into a hopper section 12, or as a free standing unit to be installed upstream of each tobacco feeder.

In the exemplary embodiment of the invention shown in FIG. 5, appropriately prepared tobacco 1 is first fed into an apparatus comprising a tobacco hopper 12 and a tobacco metering flow device 11. The tobacco metering flow device 11 provides stem extraction for consistency in the firmness and in the rate of metered tobacco 10 that is fed into the apparatus for rod making/filter forming.

Once the stems have been removed, the metered tobacco 15A is provided to a rotating vacuum wheel 10 with a vacuum chamber 18 and pneumatic lines that control the vacuum. The metered tobacco 15A is provided to a tobacco feeding plenum 14 that allows the metered tobacco 10 to free fall into a continuous groove 19 of the rotating vacuum wheel 10. The groove 19 has a shape, depth and size to allow collection of a predetermined amount of metered tobacco 15A that forms columns of metered tobacco 15B. The rotating vacuum wheel 10 collects a tobacco load from the free falling supply of metered tobacco 15A. The metered tobacco 15A is held in place in the groove 19 on the rotating vacuum wheel 10 by virtue of air pressure provided by the internal vacuum chamber 18 of the vacuum wheel 10.

The metered tobacco 15A that free falls to the rotating vacuum wheel 10 must exceed the quantity of tobacco to fill the grooves 19 by some small percentage to guarantee the groove 19 is full of tobacco at its release point. Excess tobacco 2A will be collected and returned to the rotating vacuum wheel feed or the main feed pipe to supplement the tobacco feeding plenum 14 by the excess tobacco return 2B.

Closed loop controls allow the pneumatic feed system to automatically compensate for an overfeed condition through feedback communication from the rod-making/filter forming section. Variations can be made to the rotating vacuum wheel groove 19 to allow for more dense end formation in the cigarette rod or to fill areas in concentric core cigarettes where the inner core has been crimped to a smaller size (e.g., wider or deeper or both at repeatable locations). Further, electronic timing equipment and signaling is provided from a cutter head of the rod-making/filter forming section in order to provide effective feedback of the status of the tobacco rod output 17'.

Additionally, trimming knives or discs 3 may be added to the outside edge of the rotating vacuum wheel 10 groove 19 between the filling portion of the wheel and the release point if it is determined that excess metered tobacco 10 should be trimmed from the grooves 19, 20 to assure consistent volumetric control of the tobacco rod output 17'. This may or may not be used as the vacuum filling method of embodiments of the invention controls volumetric filling consistently.

As shown in FIG. 6, the groove 19 on the rotating vacuum wheel 10 further comprises end pockets 20 that provide additional amounts of tobacco and firmness at both ends of the metered tobacco columns 15B that are produced by the rotating vacuum wheel 10. The dimensions of the end pockets 20 along the groove 19 are determined such that the ends of the columns of metered tobacco 15B provide a desired firmness of the tobacco rod. The columns of metered tobacco 15B formed in the grooves 19 of the rotating vacuum wheel 10 are ultimately released into an air transport section 29A that transports the columns of metered tobacco 15B to the rod-forming/filter making section of the apparatus.

When the metered tobacco 15A held in the grooves 19, 20 of the rotating vacuum wheel 10 reaches a release point at an inlet chamber 38 of the air transport apparatus 29A, columns of metered tobacco 15B are released from the rotating vacuum wheel 10 by positive air pressure 17 that is applied to the end pockets 20 when they reach an appropriate release point at the inlet of rod-making/filter-forming section. The rotational speed of the rotating vacuum wheel 10 is synchronized in time with the rod-making/filter-forming section to identify an optimized release point for the released columns of metered tobacco 15B.

An internal tobacco rod can be inserted into the center of the air transport device 29A. As shown in FIG. 5, an opening 27 at the rear of the air transport device 29A allows the in-line introduction of additional elements into the center of the apparatus. There are wide variety of possible rods and tubes that may be inserted into the center of the air transport device 29A including but not limited to: (1) another tobacco rod; (2) another preformed rod; or (3) a continuous tube made up of paper or MAT or extruded materials. In particular, inserting a rod/tube, as described in (1), (2) or (3), into the apparatus at the opening 27 allows for a hollow core concentric tobacco rod to be provided at the output 17' of the cigarette making apparatus. In addition, such rods or tubes may be crimped in strategically placed locations along their length to provide desirable properties to the tobacco rod-making/filter forming process. Further, the rod/tube could include, but is not limited to: cellulose acetate (CA) rod, CA/carbon rod, CA/flavors rod, paper rod, paper/carbon rod, paper/flavors rod, hollow tube, perforated hollow tube and perforated hollow tube with dams or chambers.

Significant air flow is provided to the apparatus to assure that the rod-making/filter forming section is provided with a consistent number of released columns of metered tobacco 15B. Some air flow is provided by compressed air 24 that is provided to a dual-section reducer 25A, 25B located after the air transport apparatus 29A. In particular, the position of the air transport device 29A is adjusted relative to a dual-section reducer 25A, 25B to determine an air balance by rotating an air flow balance adjusting screw 28 that shifts the air transport device 29A. The dual-section reducer 25A, 25B provides a venturi inlet opening 16.

In addition, air flow released into the venturi 16 and tongue 9 areas is contained by a dust collection device 23 that takes the dust and air away from the rod-making/filter forming section. The venturi 16 provides a restricted air inlet or constriction in the dual-section reducer 25A, 25B that causes a pressure drop when air flows through the dual-section reducer 25A, 2511.

Further, the function of this dust collection device 23 will be merged with the dust removal system for the rotating vacuum wheel 10. Further, a perforated air relief sleeve 21 is provided within the dust collection device 23 and at the output of the dual-section reducer 25A, 25B.

After the perforated air relief sleeve 21 at the output of the two-piece dual-section reducer 25A, 25B, a plurality of columns of metered tobacco 15B, which have been transported through the air transport device 29A; a tongue 9, which removes excess tobacco at the top; and paper 6, which has transported by the tube belt 4 and been preformed by 5 to cover the bottom and sides of the columns of metered tobacco 15; combine to form an open-topped tobacco rod 17. The paper 6 advanced by the tube belt 4 further advances the open-topped tobacco rod 17 through the rod-making/filter forming section onto a garniture 7 and through a folder 8A. The folder 8A closes the top seam of the open-topped tobacco rod 17 and provides a closed concentric or a closed hollow concentric tobacco rod 17' at the output of the rod-making/filter forming section of the cigarette making apparatus.

Figure 8:
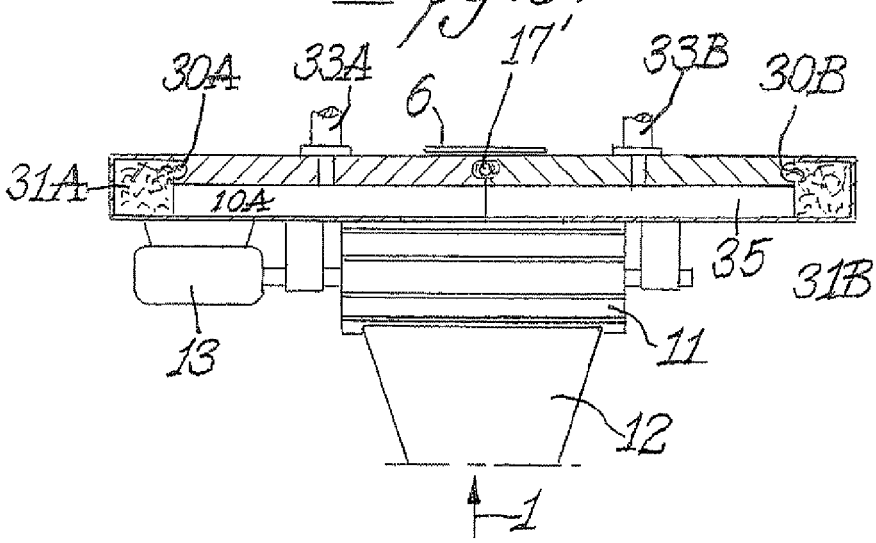
FIG. 8 shows a front view of the exemplary embodiment of the invention shown in FIG. 7.
Figure 7:
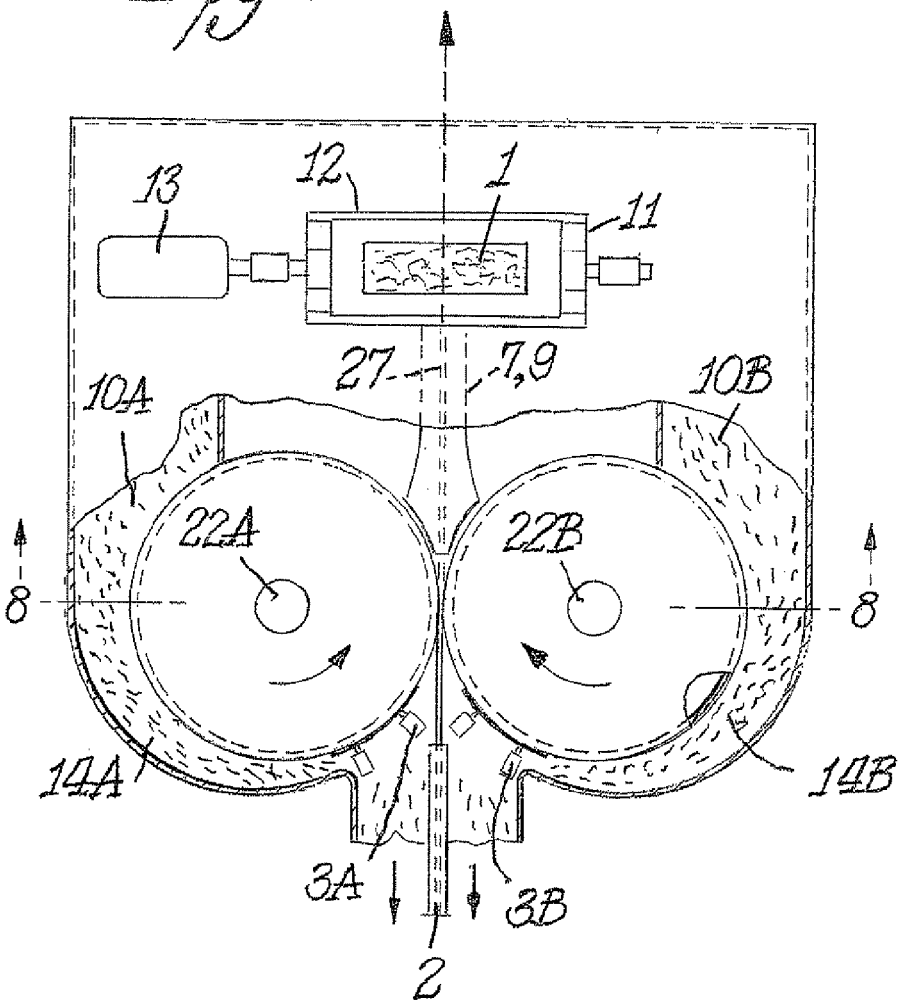
FIG. 7 shows a side view of another exemplary embodiment of the invention.

Another exemplary embodiment of the invention is shown in FIG. 7 and FIG. 8. FIG. 7 is a top view of a cigarette making apparatus with a pair of horizontally positioned, counter rotating vacuum wheels 10A, 10B that produces concentric core or hollow core concentric tobacco rods. Each rotating vacuum wheel 10A, 10B will fill a shallow groove (e.g., reference 19 as shown in FIG. 6) in each respective rotating vacuum wheel 10A, 10B that carries half the metered tobacco 15A, 15B needed to form a tobacco rod at the output. The central core tobacco rod or tube will be feed directly into an opening 27 in the middle of the tangential point between the rotating vacuum wheels 10A, 10B.

A tube belt and paper (not shown because they are beneath the tangential point located between the rotating wheels 10A, 10B) will be positioned directly under this tangential point and begin forming a concentric or hollow concentric tobacco rod with the tobacco and inner rod or tube as the material is transferred from the rotating vacuum wheels 10A, 10B by an air transport device and to shoe/tongue devices similar to references 29A, 7 and 9, respectively, of FIG. 5 and FIG. 6) or similar to traditional shoe and tongue arrangements used on cigarette makers (e.g., as shown in FIG. 1 and FIG. 2). That is, the hopper/rod-making embodiments of the invention can also be adopted to work in different configurations of the previous embodiment (e.g., horizontal rotating vacuum wheels 10A, 10B) or with cigarette rod-making technology.

As noted above, FIG. 8 is a front view of the exemplary embodiment of a cigarette making apparatus of FIG. 7. In particular, FIG. 8 shows a tobacco feed 1 into a hopper 12 that feeds a tobacco metering device 11 that is turned by motor 13. The metered tobacco 31A, 31B from the tobacco metering device 11 is fed to the pair of rotating vacuum wheels 10A, 10B which are turned by shafts 33A and 33B, respectively. The metered tobacco (e.g., see references 14 and 14A, 14B, of FIG. 5 and FIG. 7, respectively) fill the grooves and end pockets (i.e., see references 19, 20 in FIG. 6) on each rotating vacuum wheel (e.g., see references 10 and 10A, 10B of FIG. 5 and FIG. 7, respectively) and are held in place by the vacuum chamber (e.g., see reference 18 in FIG. 5). The air transport device (i.e., see reference 29A of FIG. 5) moves columns of the metered tobacco (i.e., see reference 15 of FIG. 5) released from the rotating vacuum wheels (e.g., see references 10 and 10A, 10B of FIG. 5 and FIG. 7, respectively) at an appropriate point for additional processing to produce outputs of a concentric tobacco rod or a hollow concentric tobacco rod 17' in accordance with the rod-making/filter forming sections as discussed in the previous paragraphs and as illustrated in FIG. 5 through FIG. 8.

Figure 9:
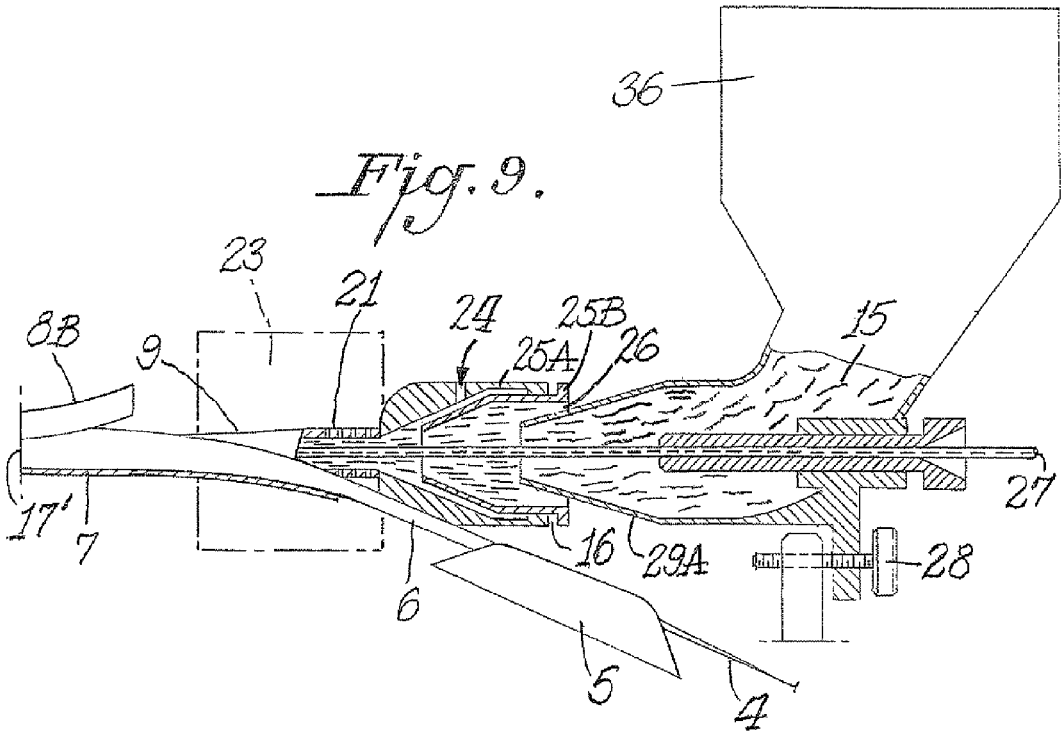
FIG. 9 shows a side view of yet another exemplary embodiment of the invention.

As another exemplary embodiment of the invention, FIG. 9 shows that the input feeding section 36 of a pneumatic cigarette making apparatus may be implemented, as described above, using either the single (FIG. 5) or dual rotating vacuum wheel (FIG. 7) configuration to supply columns of metered tobacco strands 15 directly to an air transport device 29A which processes the columns of metered tobacco strands 15, as discussed above, and delivers a concentric tobacco rod or hollow concentric tobacco rod to a garniture arrangement found in cigarette makers. A shoe (not shown) can be placed in the groove (e.g., see reference 19 of FIG. 6) at the release point where the vacuum is released and the columns of metered tobacco 15 will flow through the air transport device 29A; be processed through the rod making/filter forming section as discussed above; and be carried under a tongue 9 and through a folder 8B by the paper 6—tube belt 4 arrangement that provide for top seam sealing and output of a concentric or hollow concentric tobacco rod 17'.

Figure 10:
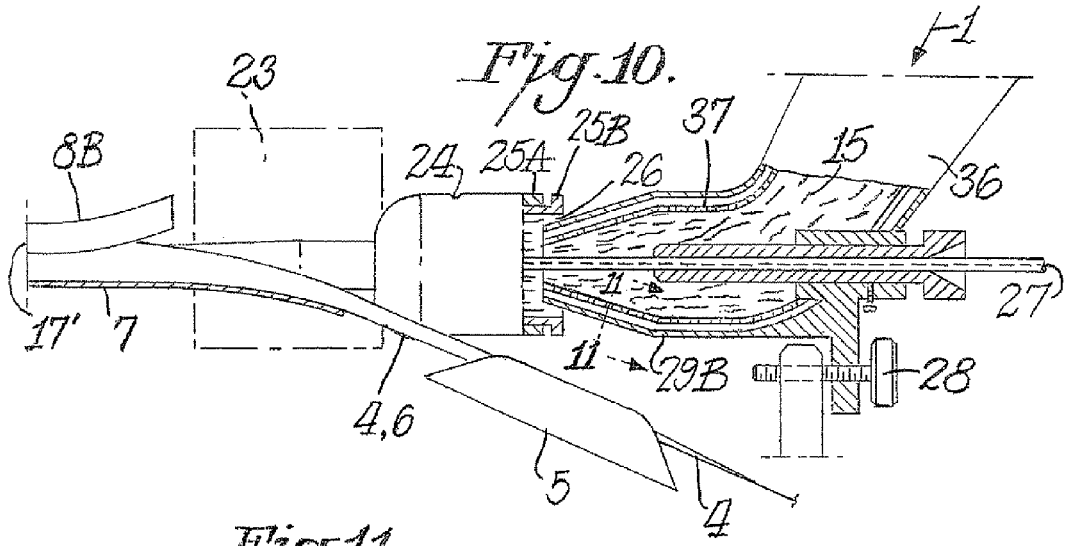
FIG. 10 shows a side view of yet another exemplary embodiment of the invention that includes a dual chamber air transport device.
Figure 11:
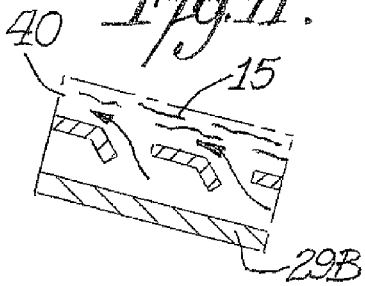
FIG. 11 shows a detailed view of the structure of the dual chamber air transport device of FIG. 10.

As yet another exemplary embodiment of the invention, FIG. 10 shows that the input feeding section 36 of a pneumatic cigarette making apparatus that may be implemented, as described above, using either the single (FIG. 5) or dual rotating vacuum wheel (FIG. 7) configuration to supply columns of metered tobacco strands 15 directly to a dual chamber air transport device 29B which processes the columns of metered tobacco strands 15, as discussed above, and delivers a concentric tobacco rod or hollow concentric tobacco rod to a garniture arrangement in cigarette makers. Additional detail of the air flow 40 in between the dual chambers of the air transport device 29B that helps transports the columns of metered tobacco 15 is shown in FIG. 11. A shoe (not shown) can be placed in the groove (e.g., see reference 19 of FIG. 6) at the release point where the vacuum is released and the columns of metered tobacco 15 will flow through the air transport device 29B; be processed through the rod making/filter forming section as discussed above; and be carried under a tongue 9 and through a folder 8B by the paper 6—tube belt 4 arrangement that provide for top seam sealing and output of a concentric or hollow concentric tobacco rod 17'.

Figure 12:
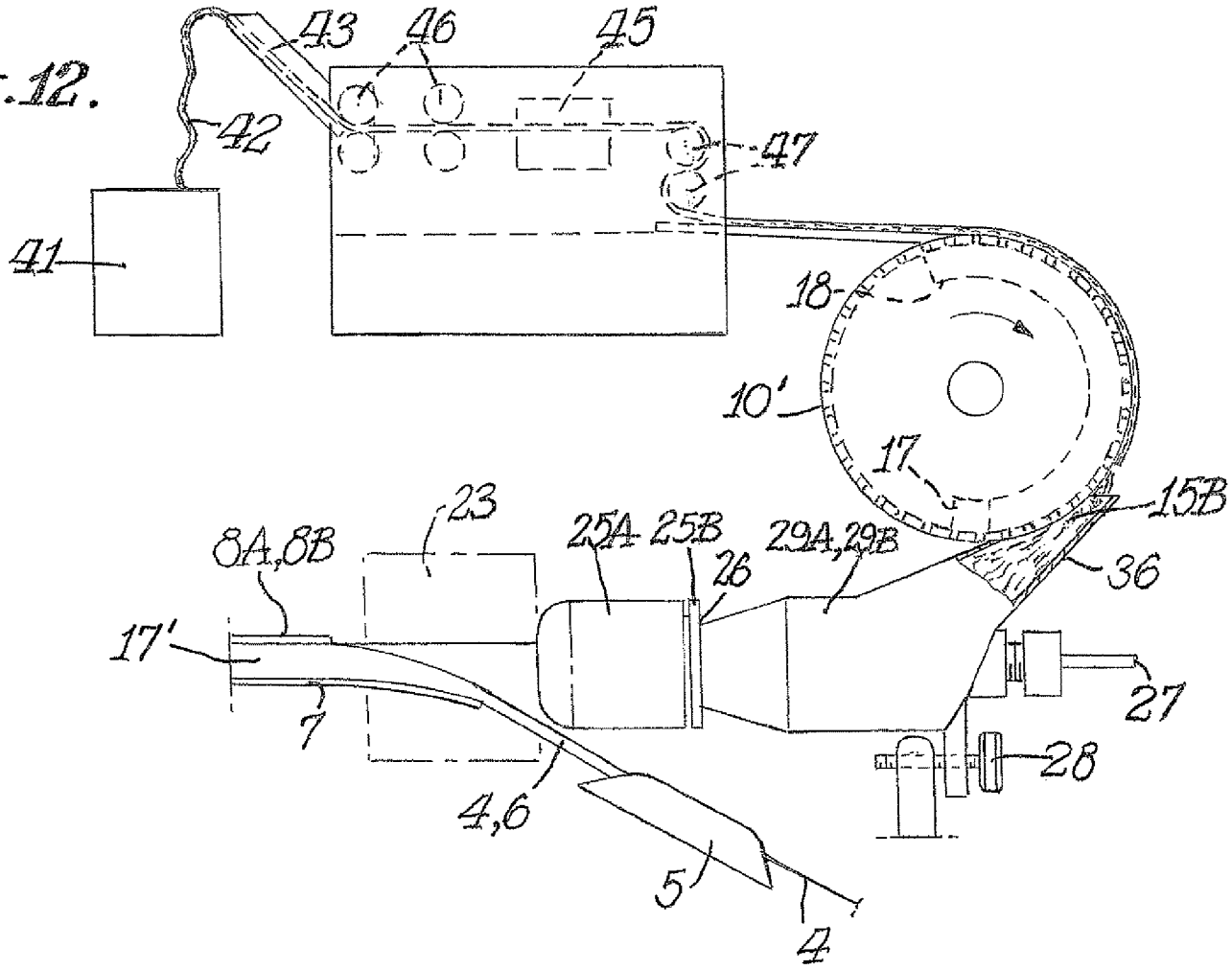
FIG. 12 is an exemplary embodiment of system that used the cigarette making apparatus of the invention.

FIG. 12 shows an exemplary embodiment of how the various embodiments of the pneumatic cigarette maker apparatus may be integrated into a cigarette manufacturing system. In particular, FIG. 12 shows how embodiments of the invention may be integrated into a tow preparation unit designed with a tow transport device for tow band directional change without a negative impact on tow yield. With the integration of the pneumatic cigarette making apparatus of the exemplary embodiments discussed above in the tow processing/filter making methodology the cigarette manufacturing process has been reconfigured into a more compact arrangement without losing filter making capability (i.e. speed, quality, tow yield, waste, etc.). All existing tow processing components are used but repackaged so that the rod-making/filter forming section is lower to the ground and the tow blooming/PZ application will be remounted on a new back plate over top of the rod-making/filter forming section.

The configuration shown in FIG. 12 comprises a tow bale 41 which provides input feed material 42 to a shaft 43. The shaft 43 provides the input feed material 42 to blooming rollers 43, 44 and on to a hopper feeding device 45 as discussed above (see references 1, 11 and 12 in FIG. 5 and FIG. 7). The input hopper feeding device 45 supplies a pneumatic cigarette making apparatus that may be implemented, as described above, using either the single (FIG. 5) or dual rotating vacuum wheel (FIG. 7) configuration to supply columns of metered tobacco strands 15 directly to a dual chamber air transport device 29B which processes the columns of metered tobacco strands 15, as discussed above, and delivers a concentric tobacco rod or hollow concentric tobacco rod to a garniture arrangement in cigarette makers. Additional detail of the air flow 40 in between the dual chambers of the air transport device 29B that helps transports the columns of metered tobacco 15 is shown in FIG. 11. A shoe (not shown) can be placed in the groove (e.g., see reference 19 of FIG. 6) at the release point where the vacuum is released and the columns of metered tobacco 15 will flow through the air transport device 29B; be processed through the rod making/filter forming section as discussed above; and be carried under a tongue 9 and through a folder 8B by the paper 6—tube belt 4 arrangement that provide for top seam sealing and output of a concentric or hollow concentric tobacco rod 17'.

The exemplary system embodiment of FIG. 12 has never been possible in the past without significant negative impact on product quality/tow yield capability because of the loss of tow bloom and PZ contamination while changing direction. The pneumatic air transport apparatus 29A, 29B of the system allows the bending of the tow without hard roller or guide contact and thus, allows for the directional change without lose of bloom or PZ contamination. As an additional alternative to the system shown above, a second set of blooming rollers may be stacked vertically stacked as shown in optional reference 47.

This embodiment of the invention provides a system that will significantly reduce the complexity of cigarette manufacturing and specifically cigarette making apparatus. Embodiments will eliminate the need for complex hoppers and their associated expense, maintenance, and quality issues. Embodiments of the invention also have the potential of eliminating the need for complex weight control systems since the rotating vacuum wheel with spaced granular receiving pockets on its periphery (e.g., see U.S. Pat. No. 5,499,636 incorporated herein by reference) will accurately and volumetrically feed the desired amount of tobacco filler material needed for each cigarette. This is assured by the elimination of the relatively high speed requirements of tobacco on the suction band and the suction chamber side rails. With vacuum wheel technology the side rails are moving with the tobacco stream which will eliminate one major cause of voids, loose ends, hopper choke-ups and paper breaks. In addition, embodiments will eliminate all of the systems and maintenance costs associated with current weight control systems. Further, embodiments of the invention can be used in conjunction with the manufacturing technologies of cigarette makers or with concentric or hollow core concentric cigarettes.

Further, if trimming of the tobacco is needed, the trimmer returns will be of a significantly lower percentage which will reduce tobacco degradation. Furthermore, the trimmer discs will be fixed to trim at the edge of the vacuum wheel groove instead of the current complex mechanism that is tied to the weight control system. Further, embodiments will significantly reduce the amount of square footage required for each cigarette maker which saves make/pack floor space that will likely find other valuable uses such as bringing filter making into each module (e.g., cigarette maker operators will be able to make their own filters and eliminate the entire separate filter making operation and overhead). Furthermore, with a compact filter maker or installation of module specific tobacco reclaim systems for real time re-feed at each maker.

Moreover, the suction band on our prototype cigarette makers is a high wear item that is made of an unacceptable material. Many attempts have been made to find acceptable materials that will perform well in this extreme application but all have failed. Thus, embodiments of the invention new will eliminate the extreme wear condition and allow for the perforated bottom of the vacuum wheel groove to be hardened steel surface that will last for months or even years instead of hours.

Figure 13:
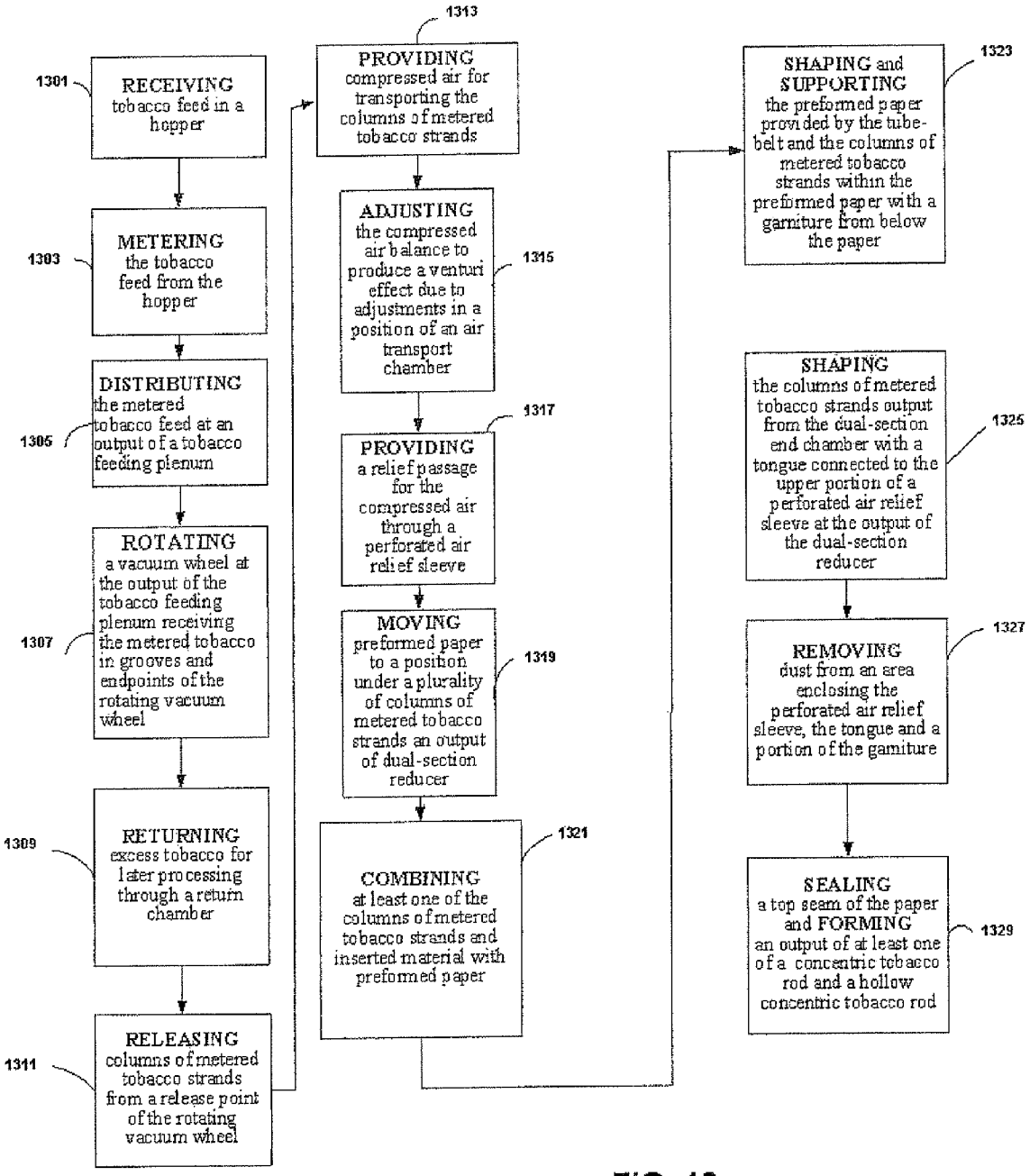
FIG. 13 is an exemplary flow diagram of a method of an embodiment of the invention.

FIG. 13 is an exemplary flow diagram of a method of an embodiment of the invention. In particular, Step 1301 of FIG. 13 is receiving a tobacco feed in a hopper. Metering the tobacco feed received from the hopper occurs in step 1303. In step 1305, the metered tobacco feed at an output of a tobacco feeding plenum is distributed. Step 1307 is rotating a vacuum wheel at the output of the tobacco feeding plenum receiving the metered tobacco in grooves and endpoints of the rotating vacuum wheel. Returning excess tobacco for later processing through a return chamber occurs in Step 1309. Columns of metered tobacco strands from a release point of the rotating vacuum wheel are released in step 1311.

Step 1313 is providing compressed air for transporting the columns of metered tobacco strands. Next, transporting the columns of metered tobacco strands on air to a rod-making/filter forming section occurs. In particular, in step 1315, adjusting the compressed air balance to produce a venturi effect due to adjustments in a position of an air transport chamber occurs. Providing a relief passage for the compressed air through a perforated air relief sleeve occurs in step 1317. Combining at least one of the columns of metered tobacco strands and inserted material with preformed paper occurs in step 1319.

Next, forming at least one of a concentric tobacco rod and a hollow concentric tobacco rod occurs. Further detail of this step includes step 1321 of moving preformed paper to a position under a plurality of columns of metered tobacco strands an output of dual-section reducer. Step 1323 is shaping and supporting the preformed paper provided by the tube-belt and the columns of metered tobacco strands within the preformed paper with a garniture from below the paper. Shaping the columns of metered tobacco strands output from the dual-section end chamber with a tongue connected to the upper portion of a perforated air relief sleeve at the output of the dual-section reducer occurs in step 1325. In step 1327, dust is removed from an area enclosing the perforated air relief sleeve, the tongue and a portion of the garniture. Step 1329 is sealing a top seam of the paper in forming an output of at least one of a concentric tobacco rod and a hollow concentric tobacco rod.

The foregoing description shows and describes the present invention. Additionally, the disclosure shows and describes only the preferred embodiments of the invention, but as mentioned above, it is to be understood that the invention is capable of use in various other combinations, modifications, and environments and is capable of changes or modifications within the scope of the inventive concept as expressed herein, commensurate with the above teachings and/or skill or knowledge of the relevant art. The embodiments described hereinabove are further intended to explain best modes known of practicing the invention and to enable others skilled in the art to utilize the invention in such or other embodiments and with the various modifications required by the particular applications or uses of the invention. Accordingly, the description is not intended to limit the invention to the form or application disclosed herein. Also, it is intended that the appended claims be construed to include alternative embodiments.

The invention claimed is:

1. An apparatus for concentric rod-making/filter-forming, comprising:

a hopper configured to receive a tobacco feed;

a metering device connected to the hopper, wherein the metering device is configured to meter the tobacco feed received from the hopper;

a tobacco feeding plenum connected to the metering device, wherein the tobacco feeding plenum is configured to distribute the metered tobacco at an output of the tobacco feeding plenum;

a rotating vacuum wheel located proximate to the output of the tobacco feeding plenum, wherein the rotating vacuum wheel is configured to receive the metered tobacco;

an excess tobacco return chamber connected to a distal portion of the tobacco feeding plenum and proximate to the rotating vacuum wheel, wherein the excess tobacco return chamber is configured to receive tobacco feed outside of grooves of the rotating vacuum wheel;

an input feeding chamber connected proximate to a release point of the rotating vacuum wheel and configured to receive columns of metered tobacco strands released from the rotating vacuum wheel;

an air transport device connected to an output of the input feeding chamber, wherein the air transport device is configured to transport the columns of metered tobacco strands to a rod-making/filter forming section; and a rod-making/filter forming section connected to the air transport device, wherein the rod-making/filter forming section further comprises a dual-section end chamber located proximate to an output of the air transport device, wherein a dual-section reducer is configured to provide compressed air for transport of the columns of metered tobacco strands, adjust balance of the compressed air in accordance with a venturi effect due to adjusting the position of the air transport device relative to the dual-section reducer; and provide relief for the compressed air through a perforated air relief sleeve, and wherein the rod-making/filter forming section is configured to combine at least one of the columns of metered tobacco strands and inserted material with preformed paper forming at least one of a concentric tobacco rod and a hollow concentric tobacco rod.

2. The apparatus of claim 1, wherein the rod-making/filter forming section further comprises:

a tube-belt, wherein the tube-belt is configured to move preformed paper to an output of the dual-section reducer;

a garniture connected to the lower portion of the perforated relief sleeve at the output of the dual-section end chamber, wherein the garniture is configured to shape and support the preformed paper provided by the tube-belt and the columns of metered tobacco strands formed into a rod within the preformed paper; and a tongue connected to the upper portion of the perforated relief sleeve at the output of the dual-section end chamber, wherein the tongue is configured to shape columns of metered tobacco strands output from the dual-section end chamber;

a dust collection device connected to the dual-section end chamber and enclosing the perforated relief sleeve, the tongue and a portion of the garniture, wherein the dust collection device is configured to remove dust and air from the rod-making/filter-forming section; and a folder connected to the tongue, wherein the folder is configured to seal a top seam of the paper forming the output of at least one of a concentric tobacco rod and a hollow concentric tobacco rod.

3. The apparatus of claim 2, wherein the rotating vacuum wheel further comprises trimmers for removing excess tobacco feed that is outside of the grooves.

4. A system for cigarette manufacturing, comprising:

a tow bale of tobacco product;

a shaft connected to the tow bale, wherein the shaft is configured to advance the tobacco product to an output of the shaft;

a plurality of blooming rollers, wherein the blooming rollers are configured to receive and provide an output of tobacco feed;

a hopper configured to receive the tobacco feed;

a metering device connected to the hopper, wherein the metering device is configured to meter the tobacco feed received from the hopper;

a tobacco feeding plenum connected to the metering device, wherein the tobacco feeding plenum is configured to distribute the metered tobacco at an output of the tobacco feeding plenum;

a rotating vacuum wheel located proximate to the output of the tobacco feeding plenum, wherein the rotating vacuum wheel is configured to receive the metered tobacco;

an excess tobacco return chamber connected to a distal portion of the tobacco feeding plenum and proximate to the rotating vacuum wheel, wherein the excess tobacco return chamber is configured to receive tobacco feed outside of grooves of the rotating vacuum wheel;

an input feeding chamber connected proximate to a release point of the rotating vacuum wheel and configured to receive columns of metered tobacco strands released from the rotating vacuum wheel;

an air transport device connected to an output of the input feeding chamber, wherein the air transport device is configured to transport the columns of metered tobacco strands to a rod-making/filter forming section; and a rod-making/filter forming section connected to the air transport device, wherein the rod-making/filter forming section further comprises a dual-section end chamber located proximate to an output of the air transport device, wherein a dual-section reducer is configured to provide compressed air for transport of the columns of metered tobacco strands, adjust balance of the compressed air in accordance with a venturi effect due to adjusting the position of the air transport device relative to the dual-section reducer; and provide relief for the compressed air through a perforated air relief sleeve, and wherein the rod-making/filter forming section is configured to combine at least one of the columns of metered tobacco strands and inserted material with preformed paper forming at least one of a concentric tobacco rod and a hollow concentric tobacco rod.

5. The system of claim 4, wherein the rod-making/filter forming section further comprises:

a tube-belt, wherein the tube-belt is configured to move preformed paper to an output of the dual-section reducer;

a garniture connected to the lower portion of the perforated relief sleeve at the output of the dual-section end chamber, wherein the garniture is configured to shape and support the preformed paper provided by the tube-belt and the columns of metered tobacco strands formed into a rod within the preformed paper; and a tongue connected to the upper portion of the perforated relief sleeve at the output of the dual-section end chamber, wherein the tongue is configured to shape columns of metered tobacco strands output from the dual-section end chamber;

a dust collection device connected to the dual-section end chamber and enclosing the perforated relief sleeve, the tongue and a portion of the garniture, wherein the dust collection device is configured to remove dust and air from the rod-making/filter-forming section; and a folder connected to the tongue, wherein the folder is configured to seal a top seam of the paper forming the output of at least one of a concentric tobacco rod and a hollow concentric tobacco rod.

6. A method for making at least one of concentric and concentric hollow tobacco rods, comprising:

receiving a tobacco feed in a hopper;

metering the tobacco feed received from the hopper;

distributing the metered tobacco feed at an output of a tobacco feeding plenum;

rotating a vacuum wheel at the output of the tobacco feeding plenum receiving the metered tobacco in grooves and endpoints of the rotating vacuum wheel;

returning excess tobacco for later processing through a return chamber;

releasing columns of metered tobacco strands from a release point of the rotating vacuum wheel;

transporting the columns of metered tobacco strands on air to a rod-making/filter forming section, wherein the transporting further comprises providing compressed air for transporting the columns of metered tobacco strands, adjusting the compressed air balance to produce a venturi effect due to adjustments in a position of an air transport chamber, and providing a relief passage for the compressed air through a perforated air relief sleeve;

combining at least one of the columns of metered tobacco strands and inserted material with preformed paper; and forming at least one of a concentric tobacco rod and a hollow concentric tobacco rod.

7. The method of claim 6, wherein the forming at least one of a concentric tobacco rod and a hollow concentric tobacco rod further comprises:

moving preformed paper to a position under a plurality of columns of metered tobacco strands an output of dual-section reducer;

shaping and supporting the preformed paper provided by the tube-belt and the columns of metered tobacco strands within the preformed paper with a garniture from below the paper;

shaping the columns of metered tobacco strands output from the dual-section end chamber with a tongue connected to the upper portion of a perforated air relief sleeve at the output of the dual-section reducer;

removing dust from an area enclosing the perforated air relief sleeve, the tongue and a portion of the garniture; and seal a top seam of the paper to form an output of at least one of a concentric tobacco rod and a hollow concentric tobacco rod.

* * * * *